US005303624A

United States Patent [19]

Ventham et al.

[11] Patent Number: 5,303,624

[45] Date of Patent: Apr. 19, 1994

[54] APPARATUS FOR CUTTING SHEET MEDIA

[75] Inventors: John C. Ventham, Georgetown; Ralph J. Lake, Jr., Austin, both of Tex.

[73] Assignee: Summagraphics Corporation, Seymour, Conn.

[21] Appl. No.: 860,000

[22] Filed: Mar. 30, 1992

[51] Int. Cl.[5] ..... B26D 1/18; B26D 1/30

[52] U.S. Cl. ..... 83/202; 83/436; 83/485; 83/602; 83/607; 83/939

[58] Field of Search ..... 83/602, 628, 936, 937, 83/938, 607, 578, 584, 939, 940, 941, 649, 949, 485, 436, 212.1, 202; 30/228, 216, 180, 247, 238, 237, 245

[56] References Cited

U.S. PATENT DOCUMENTS

| | | | |
|---|---|---|---|
| 487,068 | 11/1892 | Drinkwater | 30/245 X |
| 2,244,638 | 6/1941 | Boardman | 30/228 |
| 2,250,589 | 7/1941 | Piccolo | 30/228 X |
| 2,400,527 | 5/1946 | Aycock | 83/483 |
| 2,452,312 | 10/1948 | McMurray | 83/483 |
| 2,482,582 | 9/1949 | Grafe | 30/228 X |
| 3,189,997 | 6/1965 | Mount | 30/228 |
| 3,260,147 | 7/1966 | Farabee | 83/542 |
| 3,262,201 | 7/1966 | Docken | 30/228 X |
| 3,589,222 | 6/1971 | Sederberg | 83/49 |
| 3,735,660 | 5/1973 | Pearl | 83/560 |
| 3,772,949 | 11/1973 | Pavone et al. | 83/56 |
| 3,938,414 | 2/1976 | Rémond | 83/936 X |
| 4,294,144 | 10/1981 | Hayes | 83/212.1 |
| 4,355,794 | 10/1982 | Costigan | 270/31 |
| 4,401,001 | 8/1983 | Gerber et al. | 83/451 |
| 4,537,582 | 8/1985 | Liu | 493/38 |
| 4,545,275 | 10/1985 | Pearl | 83/747 |
| 4,643,061 | 2/1987 | Gerber | 83/174.1 |
| 4,685,363 | 8/1987 | Gerber | 83/22 |
| 4,691,605 | 9/1987 | Vanetik et al. | 83/175 |
| 4,841,822 | 6/1989 | Gerber | 83/174 |
| 4,907,014 | 3/1990 | Tzeng et al. | 346/24 |
| 4,995,287 | 2/1991 | Nasu | 83/938 X |

*Primary Examiner*—Richard K. Seidel
*Assistant Examiner*—Kenneth E. Peterson
*Attorney, Agent, or Firm*—Rosen, Dainow & Jacobs

[57] ABSTRACT

Motor-driven cutting apparatus for cutting sheet media are disclosed, particularly for use with plotter and printer apparatus. The cutting apparatus of one embodiment comprises two cutting members in which at least one of the cutting members is moved both angularly and linearly, e.g., pivoted and reciprocated, relative to the other to cut media placed between the two cutting members. In another embodiment, the cutting members are both simultaneously pivoted relative to each other. Rotary motion of a driving member, e.g. a motor shaft or a shaft coupled to a motor shaft, is converted to combined angular and straight line motion or only angular motion at one or both cutting members by a simplified coupling arrangement which may comprise simple sleeves with eccentric structure and pivot-type joints. Cutting apparatus according to the invention may be used for X-axis and/or Y-axis cutting.

1 Claim, 6 Drawing Sheets

APPARATUS FOR CUTTING SHEET MEDIA

BACKGROUND OF THE INVENTION

The present invention relates to apparatus particularly for use in plotter and printer apparatus for cutting sheet media.

U.S. Pat. Nos. 2,452,312 (McMurray), 3,260,147 (Farabee), 3,589,222 (Sederberg), 3,735,660 (Pearl), 4,545,275 (Pearl) and 4,841,822 (Gerber) all disclose sheet material cutting apparatus which include a movable cutting member reciprocated by an electric motor and structure coupling the cutting member to the motor. In the cutting apparatus disclosed in those patents, the movable cutting member is displaced, i.e., reciprocated, in a straight line relative to the media and/or a stationary cutting member. Such cutting apparatus utilize a mechanism or linkage to convert the motor rotary motion to straight-line motion to reciprocate the movable cutting member, and/or a guide structure for guiding the movable cutting member in a straight line. The cutters of the Sederberg '222, the Pearl '660, the Pearl '275 and the Gerber '822 patents are mounted on a carriage movable in the Y-direction, and either that carriage is mounted on a carriage simultaneously movable in the X-direction or the material to be cut is simultaneously movable in the X direction, so that cuts may be made along lines in any desired direction. Circular- or disc-type sheet cutting apparatus are disclosed for example in U.S. Pat. Nos. 2,400,527 (Aycock), 3,772,949 (Pavone et al.), 4,355,794 (Costigan), 4,401,001 (Gerber et al.), 4,643,061 (Gerber), 4,685,363 (Gerber), 4,691,605 (Vanetik et al.) and 4,907,014 (Tzeng et al.). Such circular cutting apparatus may be mounted to cut sheet media parallel to the X-axis, parallel to the Y-axis or along any desired line. U.S. Pat. No. 4,537,582 (Liu) discloses slitting paper in a plotter, i.e., cutting the paper parallel to the X-axis.

SUMMARY OF THE INVENTION

It is an object of the invention to provide simplified motor-driven, sheet media cutting apparatus.

It is another object of the invention to provide such simplified motor-driven, sheet media cutting apparatus for carriage mounting, particularly for use with plotting and printing apparatus.

It is another object of the invention to provide improved cutting apparatus for continuously shearing sheet media.

It is another object of the present invention to provide cutting apparatus for cutting sheet media which is safe to operate.

It is another object of the present invention to provide cutting apparatus for multi-directional cutting of sheet media in continuous linear and curved paths.

It is another object of the invention to provide cutting apparatus which satisfies the above objects and is also lightweight and inexpensive.

The invention is based upon the dual recognition (a) that it is not necessary to move the movable cutting member of sheet media cutting apparatus solely in a straight line relative to sheet media and/or another cutting member in order to achieve good cutting action, but that good cutting action may be obtained by allowing at least some angular movement of the movable cutting member with respect to the sheet media and/or another cutting member, and (b) that such tolerance of angular movement of the movable cutting member simplifies the structure needed to couple a motor-driven rotating shaft to the movable cutting member.

The invention achieves various of the above objects and other objects by providing motor-driven cutting apparatus comprising two cutting members in which at least one of the cutting members is coupled so as to allow it to move at an angle relative to the other cutting member to cut media placed between the two cutting members. In specific embodiments of the invention, the one cutting member is coupled to move both at an angle and reciprocate relative to the other cutting member, or to move primarily or solely at an angle relative to the other cutting member. For example, in one embodiment, the one cutting member both pivots and reciprocates relative to the other cutting member, and in another embodiment, the one cutting member only pivots relative to the other cutting member. In the specific embodiments in which the one cutting member both moves at an angle and reciprocated relative to the other cutting member, the one cutting member primarily reciprocates with the angular motion being permitted to simplify the structure needed to couple a motor-driven rotating shaft to the one cutting member.

In accordance with the invention, rotary motion of a driving member, e.g. a motor shaft or a shaft coupled to a motor shaft, is converted to combined angular motion and reciprocation at one cutting member, or is converted solely to angular motion at one or both cutting members, by simplified coupling arrangements, which for example may be simple sleeves with eccentric structures and simple pivot-type joints.

In cutting apparatus embodying the invention, the point of intersection of the two cutting edges of the cutting members moves normal to the direction of the moving cutting edges's motion in the plane of the media being cut. The movable cutting edge or edges thus move generally perpendicular to the plane of the sheet media being cut and the point of intersection of the cutting edges of the cutting members is displaced parallel to the plane of the sheet media being cut. This produces good cutting action primarily from a shearing action but also to a limited extent from a sawing action. Such sawing action takes place because there is some angular movement (e.g. pivoting) of the cutting member or members and the cutting member or members do not move strictly in a straight line. The cutting movement achieved by the invention results in continuous cutting of sheet media when the cutting apparatus and the sheet media are substantially continuously moved relative to each other.

In accordance with a feature of the invention, the cutting members are arranged such that a relatively small angle of less than 90° and preferably less than 45° is subtended between the cutting edges of the cutting members, thereby reducing the exposure of the cutting edges. Since the cutting edges are of a wide angle (unlike a knife edge) and are exposed only within a small angle, and move through a short distance, the risk of accidental contact with the cutting edges by personnel is reduced.

Apparatus in accordance with the invention for cutting sheet media comprises first and second cutting members each having a cutting edge and means for holding the first and second cutting members in an adjacent relationship with at least respective portions of the cutting edges spaced apart and facing each other such that sheet media to be cut may be placed between the facing portions of the cutting edges and such that at least one of the first and second cutting members may be moved angularly and reciprocated, or only angularly, relative to the other to cause the facing cutting edge portions to cut sheet media placed therebetween. The holding means comprises means for coupling at least the first cutting member to a rotatable shaft such that the holding means causes at least the first cutting member to move angularly and reciprocated or only angularly, relative to the second cutting member in response to rotation of the shaft.

The holding means also comprises means pivotally connecting the cutting members in the adjacent relationship for pivotal movement at least of the first cutting member relative to the second cutting member in response to rotation of the rotatable shaft. In one embodiment the holding means comprises means for supporting the second cutting member fixed relative to the first cutting member. In another embodiment the coupling means couples both the first and the second cutting members for movement.

The coupling means in one embodiment comprises a sleeve having a bore therein for receiving the rotatable shaft, means for fixing the sleeve to the shaft to rotate therewith and means connected to or forming part of the sleeve which rotates with the sleeve eccentrically of the bore to which the first cutting member is connected for moving the first cutting member in response to rotation of the sleeve. The holding means comprises a pivot-type joint which pivotally connects first and second cutting members so that the first cutting member both pivots and reciprocates relative to the second cutting member upon rotation of the sleeve.

In one embodiment, the first and second cutting members are each provided with two cutting edges. The cutting edges are arranged in sets facing in opposite directions, with each set being held in an adjacent relationship by the holding means. Movement of at least one of the cutting members activates both sets of cutting edges, with one set or the other cutting sheet media depending upon the direction of relative movement between the cutting apparatus and the sheet media.

The coupling means in another embodiment comprises a sleeve having an elliptical groove to which one end of each of the cutting members is coupled. The holding means comprises a simple pivot joint pivotally connecting the cutting members at a location between the cutting edges and the ends coupled to the sleeve so that rotation of the sleeve pivots the cutting members.

Typically, cutting apparatus is mounted to cut media perpendicular to the direction of motion of the media in the particular sheet handling or plotting or printing apparatus, i.e., the cutting apparatus is mounted to cut media parallel to the Y-axis. However, in some applications the media is cut or slit parallel to the X-axis. The cutting apparatus of the invention has been found to operate quite well for cutting media both parallel to the Y-axis and parallel to the X-axis.

In some apparatus, the media is moved parallel to the X-axis and the cutting apparatus is moved parallel to the Y-axis. Circular cutters of the type referred to above typically comprise a free-rolling circular- or disc-like cutting element which cooperates with a platen along which the cutting element is moved to rotate the cutting element over the media. However, such a cutting apparatus if held stationary, as for example during slitting of the media (X-axis cutting), does not operate entirely satisfactorily because the cutting element may not continuously rotate, or may not rotate at all. The cutting apparatus of the invention, however, operates quite well regardless of whether the media is moved relative to the stationary cutting apparatus, or the cutting apparatus is moved relative to a stationary media. Therefore, cutting apparatus according to the invention find use in sheet handling apparatus, particularly plotters and printers, for cutting the media parallel to the Y-axis for separating a sheet of media from a roll thereof, and for cutting the media parallel to the X-axis for slitting the media.

As discussed above, circular-type cutting apparatus are not especially suited for cutting when the cutting apparatus is stationary and the media is moved relative to the cutting apparatus, and therefore are not presently preferred for slitting media in plotting apparatus in which the media is moved parallel to the X-axis. In accordance with the invention, however, a cutting apparatus of the circular type is provided in a sheet handling apparatus (e.g., plotter or printer) for cutting parallel to the Y-axis, and a cutting apparatus according to the invention is provided for cutting the media parallel to the X-axis.

The ability to cut parallel to the X-and Y-axes in a plotter or printer application enables a wide sheet roll, e.g. 36 inches, to be printed or plotted upon and then cut into smaller pages, e.g., 8½ inches by 11 inches.

Also, one or more of the inventive cutting apparatus may be mounted in accordance with the invention for cutting both parallel to the X-axis and parallel to the Y-axis. Inventive cutting apparatus may also be movably mounted for cutting along vectors ("vector cutting").

The inventive cutting apparatus is preferably provided as an assembly with an electric motor. Providing such an assembly allows pre-testing thereof and simplifies mounting of the cutting apparatus to a carriage, for example, of a plotter or printer.

BRIEF DESCRIPTION OF THE DRAWINGS

The invention is illustrated by way of example and not limitation in the figures of the accompanying drawings in which like references refer to like or corresponding parts, and in which.

DESCRIPTION OF THE PREFERRED EMBODIMENTS

It will be understood that the invention is not limited to the embodiments illustrated and described, and that the drawings are for purposes of illustration only and are not intended as a definition of the limits of the invention.

Figure 1:
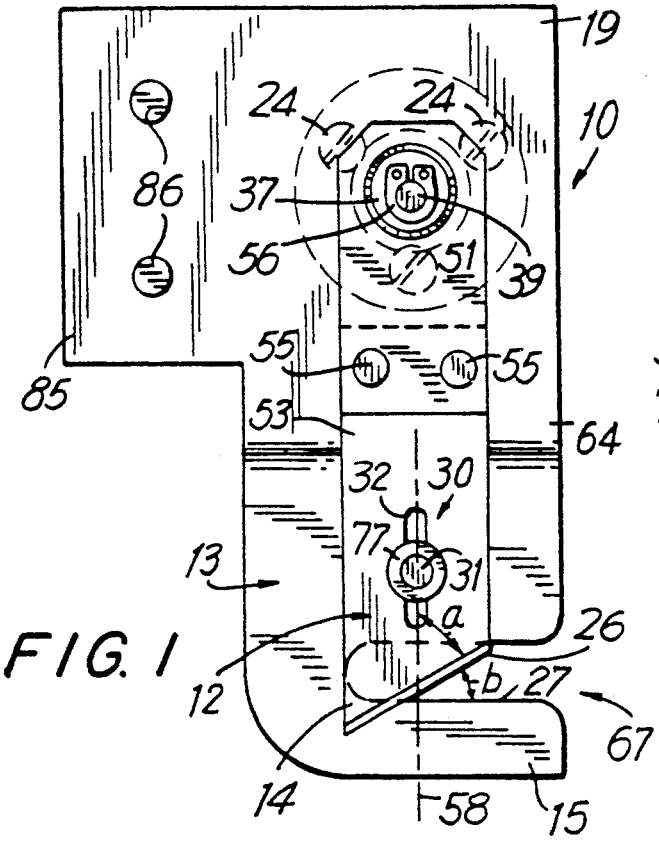
FIG. 1 is a front elevation view of apparatus for cutting sheet media according to the invention.
Figure 2:
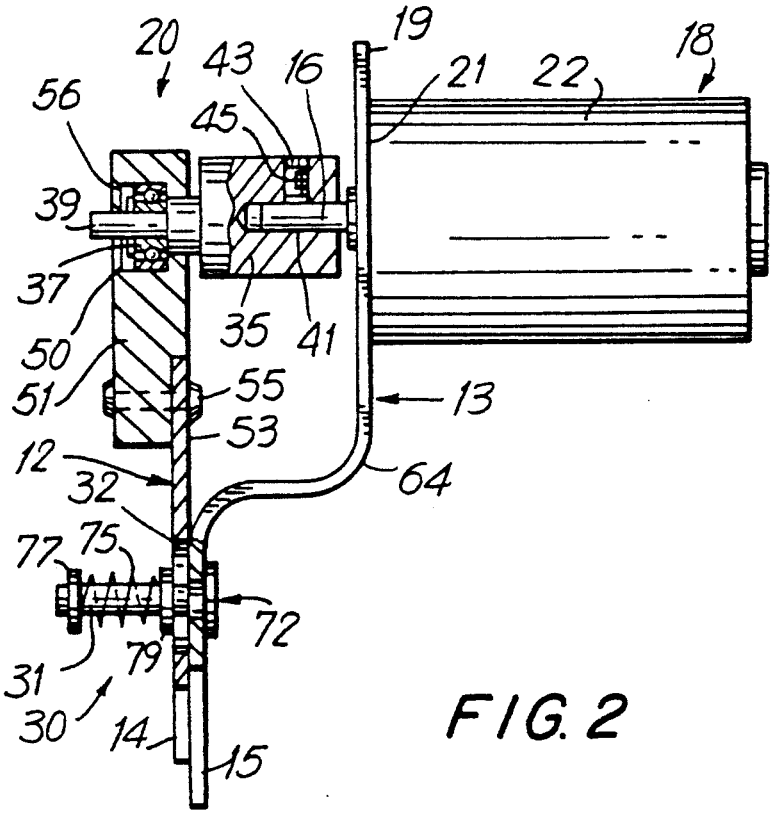
FIG. 2 is a side view of the cutting apparatus depicted in FIG. 1 with parts thereof shown in section.

Referring to FIGS. 1 and 2, cutting apparatus 10 for cutting sheet media (not shown) comprises a movable first cutting member 12 and a stationary or fixed cutting member 13. Movable first cutting member 12 is coupled to shaft 16 (FIG. 2) of motor 18 by coupling mechanism 20, and one end 19 of stationary second cutting member 13 is fixed to the end face 21 of the housing 22 of motor 18 by suitable means such as screws 24. Each cutting member 12, 13 includes at an end thereof 14, 15 spaced from motor 18 a cutting edge 26, 27. Cutting edges 26, 27 are angled (in cross section) on the opposite, non-facing sides of the respective cutting members. The first and second cutting members 12 and 13 are pivotally connected together by a pivot-type joint 30 comprising a pivot pin 31 rigidly attached to cutting member 13 near the cutting edges 27, 28, and a slot 32 in cutting member 12 in which pivot pin 31 operates, so that movable first cutting member 12 both pivots and reciprocates relative to stationary second cutting member 13 when motor shaft 16 is rotated. Coupling mechanism 20, screws 24 and pivot-type joint 30 cooperate to hold the first and second cutting members 12, 13 in an adjacent relationship with respective edge portions of cutting edges 26, 27 spaced apart and facing each other such that cutting edges 26, 27 intersect to cut sheet media placed between the facing portions thereof upon pivoting and reciprocation of movable first cutting member 12.

Coupling mechanism 20 comprises a sleeve 35 (FIG. 2) fixed to motor shaft 16 to rotate therewith, a pin or shaft 39 projecting from sleeve 35 and a bearing 37 coupling pin 39 to movable first cutting member 12. Sleeve 35 has a central axial bore 41 which receives motor shaft 16 therein, and a threaded radial bore 43 which receives a set screw 45 for fixing sleeve 35 to motor shaft 16. Pin 39 is fixed to sleeve 35 to rotate therewith and extends from sleeve 35 eccentrically of the axis of axial bore 41. Pin 39 rotates when motor shaft 16 rotates and is also displaced about a circular path due to the eccentric mounting thereof relative to axis of axial bore 41. Bearing 37, which may be of the bearing ball type as shown, is received in a circular recess 50 of a connecting member 51 fixed to an end 53 of movable first cutting member 12 by suitable means a such as pin or rivet 55. A snap ring 56 engaging a circumferential groove on the end of pin 39 retains bearing 37 in recess 50.

As mentioned above, end 19 of fixed second cutting member 13 is attached to the end face 21 of motor housing 22. The central portion 64 of fixed second cutting member 13 is curved away from motor 18 (see FIG. 2) to position end portion 15, in which the cutting edge 27 is formed, adjacent to end 14 of first movable cutting member 12. Cutting edge 27 is formed on one of the edges defined by a recess or slot 67 (FIG. 1) in fixed second cutting member 13 and extends generally parallel to the plane of sheet media being cut. Cutting edge 26 of movable cutting member 12 forms an angle "a" (FIG. 1) with the longitudinal axis 58 of movable cutting member 12. The longitudinal axis 58 is perpendicular to the plane of sheet media placed between cutting edges 26, 27. Cutting edges 26 and 27 intersect at a point and form an angle "b" which is the complement of the angle "a". The portion of fixed second cutting member 13 supporting cutting edge 27 is downstream of that point of intersection so that it does not interfere with cutting and clears the cut media.

For safety reasons, it is preferred that angle "b" be less than about 90°, and more preferably less than about 45° and in the range of about 25° to about 35°. In the preferred embodiment, angle "b" is about 30°. The smaller the angle, consistent with good shearing action between cutting edges 26 and 27, the less exposed are the cutting edges and the less likely it is that personnel may accidentally contact a cutting edge. Moreover, the travel of movable first cutting member 12 is relatively short and cutting action occurs within a relatively small recess, which further reduce the risk of accidental contact by personnel.

Figure 3:
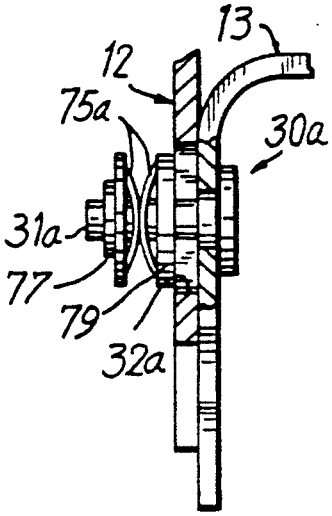
FIG. 3 is section view similar to that in FIG. 2 showing a portion of the cutting apparatus of FIG. 1 but with a different pivot arrangement than that shown in FIGS. 1 and 2.

Pivot-type joint 30 comprises slot 32 in movable first cutting member 12 and pin 31 fixed to second cutting member 13 with the pin 31 extending through hole 70. A coil spring 75 is mounted on pin 31 between a snap ring or clip 77 engaged in a circumferential groove in pin 31 and a low friction washer 79 (e.g., Delrin) adjacent first cutting member 12, and urges cutting members 12 and 13 into contact with each other. Slot 32 is sized to permit pivoting movement of first cutting member 12 and reciprocating movement of first cutting member 12 substantially parallel to the longitudinal axis 58 thereof. Other pivots may be employed, as for example pivot 30*a* shown in FIG. 3, which includes a pin 31*a* similar to pin 31, a slot 32*a* similar to slot 32 and curved spring washers 75*a* held between snap ring 77 and washer 79 urging cutting members 12 and 13 together.

Referring to FIG. 1, the circular displacement of sleeve shaft 39 described above resulting from rotation of motor shaft 16, in cooperation with bearing 37 and pivot 30, causes movable first cutting member 12 to pivot relative to fixed second cutting member 13 and to also reciprocate generally parallel to the longitudinal axis 58 of first cutting member 12. Cutting edge 26 thus moves generally perpendicular to the plane of the sheet media being cut and the point of intersection of cutting edges 26 and 27 is displaced parallel to the plane of the sheet media being cut. This combined pivoting and reciprocating movement of first cutting member 12 provides good cutting action of cutting edges 26 and 27 by a repetitive shearing action and to a limited extent by a repetitive sawing action, and at the same time, doing so with a relatively simple coupling mechanism 20 because first cutting member 12 is allowed to pivot relative to second cutting member 13. Such good cutting action takes place even though movable first cutting member 12 pivots and does not move strictly in a straight line. This cutting movement results in continuous cutting of sheet media (not shown) placed between cutting edges 26, 27 with substantially continuous advancement of the cutting apparatus relative to the sheet media (or substantially continuous advancement of the sheet media relative to the cutting apparatus, or substantially continuous advancement of both relative to each other). Other relatively simple coupling mechanisms may be used, for example as shown in FIGS. 4–9. Also, other configurations of cutting members and other movable arrangements of the cutting members may be used, for example as shown in FIGS. 4–9.

Figure 10:
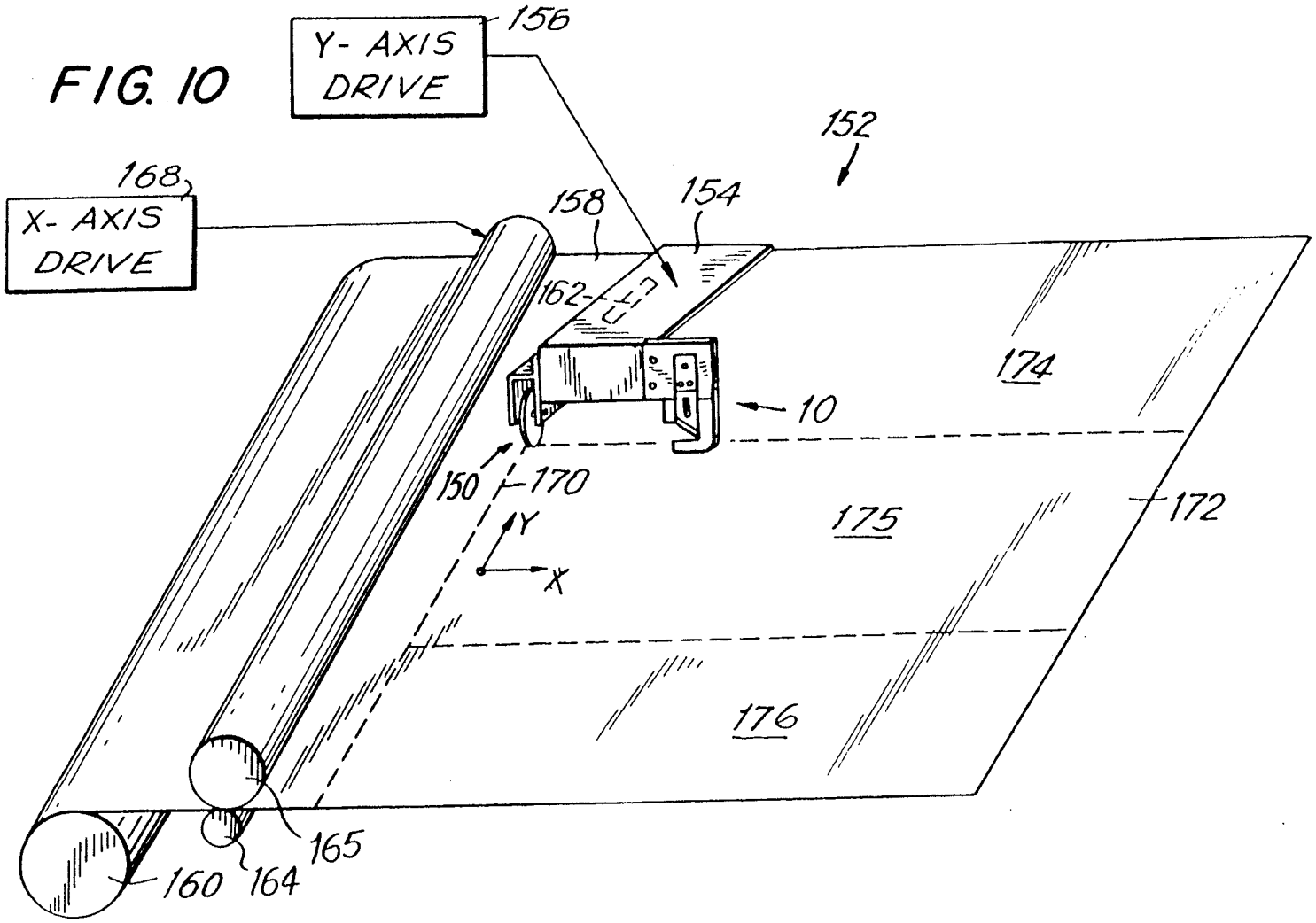
FIG. 10 is a schematic and block diagram of a plotter apparatus showing two cutting apparatuses according to the invention mounted to the plotter for cutting sheet media parallel to the X-axis and parallel to the Y-axis.

Fixed cutting member 13 (FIG. 1) which is securely fastened to motor housing 22 may be used to mount cutting apparatus 10 as a unit or assembly to a carriage (not shown), for example of a printer or plotter. For that purpose, fixed cutting member 13 in the end portion 19 thereof includes a flanged portion 85 having screw holes 86 therein by which the fixed cutting member 13 may be attached to the carriage. As described in more detail below, cutting apparatus 10 may be mounted to a plotter carriage for cutting media parallel to the Y-axis and/or parallel to the X-axis, as shown in FIG. 10. The cutting apparatus 10 may also be mounted to a fixed frame to cut media parallel to the X-axis by movement of the media parallel to the X-axis.

Figure 4:
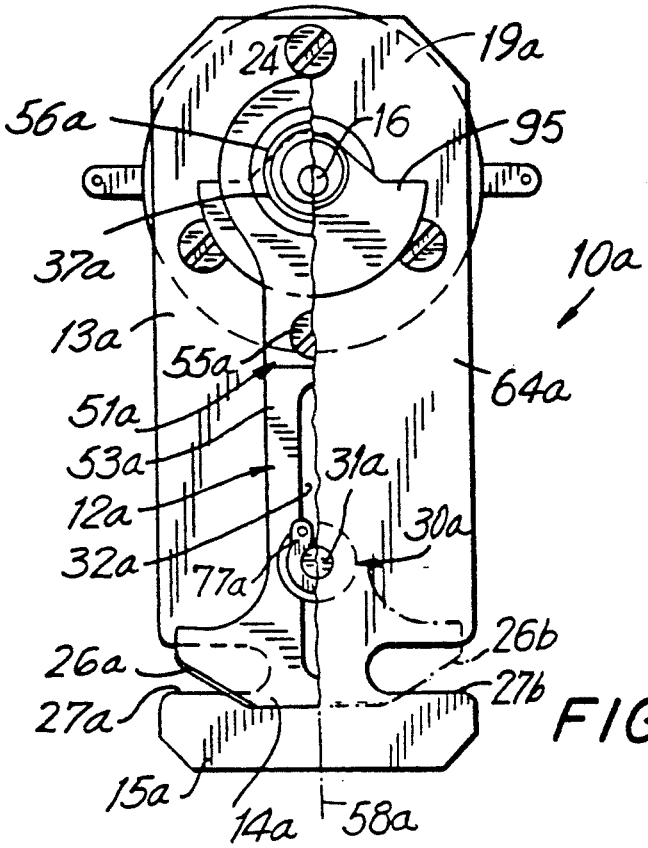
FIG. 4 is a front elevation view, partly broken away, of apparatus for cutting sheet media according to another embodiment of the invention.
Figure 5:
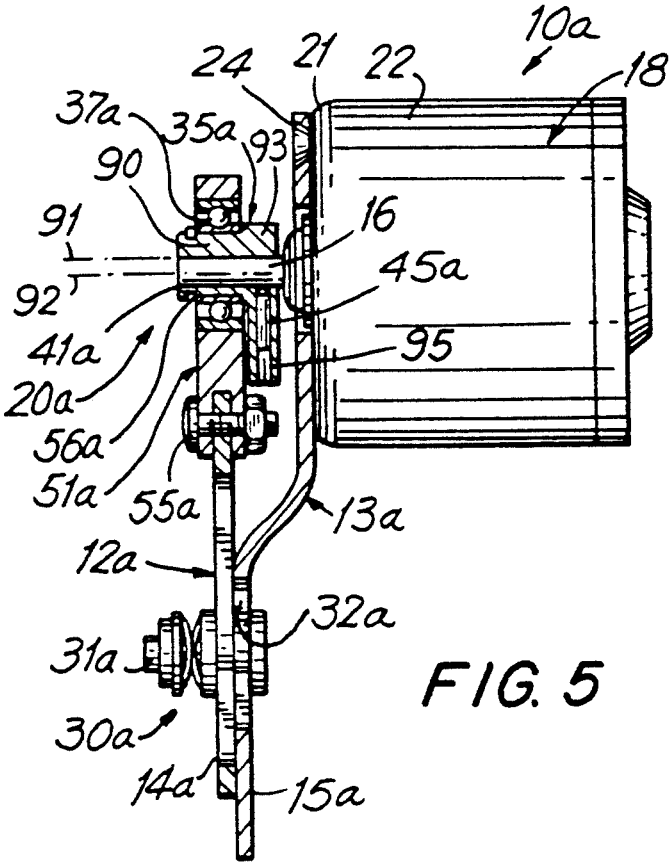
FIG. 5 is a side view of the cutting apparatus depicted in FIG. 4 with parts thereof shown in section.

The cutting apparatus 10*a* shown in FIGS. 4 and 5 cuts sheet media in either direction of relative movement between the cutting apparatus and the sheet media, thereby avoiding the necessity of returning the cutting apparatus to the same start position before each cutting operation. Cutting apparatus 10*a* comprises a movable cutting member 12*a* coupled to motor shaft 16 by coupling mechanism 20*a* and fixed cutting member 13*a* fastened to the housing 22 of motor 18 as described for cutting apparatus 10. Pivot 30*a* comprising pivot pin 31*a* and slot 32*a* (described above in connection with FIG. 3) permits movable cutting member 12*a* to pivot relative to fixed cutting member 13*a* and to reciprocate as described above for cutting apparatus 10, and urges cutting members 12*a* and 13*a* together as described above in connection with FIG. 3.

Referring to FIG. 4, movable member 12*a* has a pendulum shape, and includes two cutting edges 26*a*, 26*b* at end 14*a* thereof. The right side of movable cutting member 12*a* which is not fully shown is a mirror image of the left side. Fixed cutting member 13*a* similarly includes at end 15*a* thereof two cutting edges 27*a*, 27*b*. One set of cutting edges 26*a*, 27*a* cuts in one direction of relative movement between apparatus 10*a* and the sheet media and another set 26*b*, 27*b* cuts in the opposite direction of relative movement. Cutting edges 26*a*, 26*b* extend at an angle "a" with respect to the longitudinal axis 58*a* of movable cutting member 12*a*, and each set of cutting edges 26*a*, 27*a* and 26*b*, 27*b* intersects at a point and forms the angle "b" (neither angle is designated in FIGS. 4 and 5). Each set of cutting edges is configured and operates as described above in connection with cutting apparatus 10.

Coupling mechanism 20*a* (FIG. 5) comprises a sleeve 35*a* having a bore 41*a* which receives motor shaft 16. A set screw 45*a* fixes sleeve 35*a* to motor shaft 16 to rotate therewith. Sleeve 35*a* has a cylindrical portion 90 of reduced diameter having a central axis 91 which is eccentric to the axis 92 of bore 41*a*. A flange portion 93 on sleeve 35*a* adjacent motor 18 functions as a thrust bearing for the connecting member 51*a* received on the cylindrical sleeve portion 90, which with bearing 37*a* mounted movable cutting member 12*a* to sleeve 35*a*. Connecting member 51*a* includes a hole therethrough in which is mounted bearing 37*a*. The reduced diameter cylindrical portion 90 of sleeve 35*a* is received in bearing 37*a* to rotatably mount connecting member 51*a* to sleeve 35*a*. A snap ring 56*a* engaging a circumferential groove in sleeve 35*a* retains bearing 37*a* on sleeve 35*a*. A washer 95 having the same diameter as that of sleeve 93 is positioned between snap ring 56*a* and bearing 37*a*. Connecting member 51*a* is attached to movable cutting member 12*a* by a fastener 55*a*.

Due to the eccentricity of sleeve bore 41*a* (FIG. 5) relative to the central axis 91 of sleeve cylindrical portion 90, upon rotation of motor shaft 16, the central axis 91 of cylindrical portion 90 is displaced along a circular path, as described above for sleeve shaft 39. Referring to FIGS. 4 and 5, the circular displacement of central axis 91 resulting from rotation of motor shaft 16, in cooperation with bearing 37*a* and pivot 30*a*, causes movable first cutting member 12*a* to pivot relative to fixed second cutting member 13*a* and to also reciprocate generally parallel to the longitudinal axis 58*a* of first cutting member 12*a*. Cutting edges 26*a*, 26*b* (FIG. 4) thus move generally perpendicular to the plane of the sheet media being cut and the respective points of intersection of cutting edges 26*a*, 26*b* and 27*a*, 27*b* are displaced parallel to the plane of the sheet media being cut, resulting in good cutting action in both relative directions of movement, as described above in connection with cutting apparatus 10.

A counterbalance mass 95 (FIG. 5) connected to or forming part of sleeve 35*a* is positioned on the same side of central axis 91 as is bore axis 92 to balance sleeve 35*a* and coupling mechanism 20*a* during rotation thereof. Sleeve 35*a* which supports the movable cutting member 12*a* and produces movement thereof is positioned very close to the motor bearings for optimum rigidity.

Figure 6:
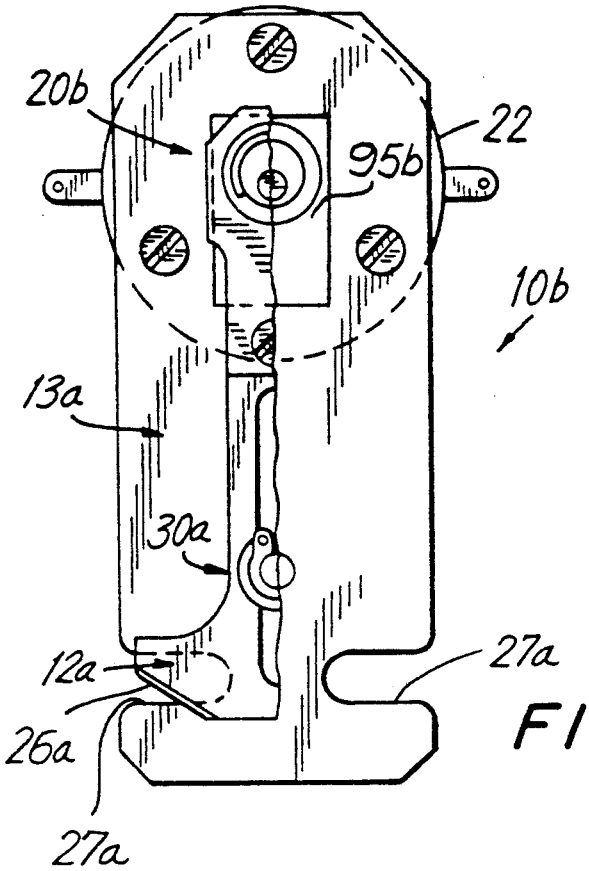
FIG. 6 is a front elevation view, partly broken away, of apparatus for cutting sheet media according to another embodiment of the invention, similar to the embodiment of FIG. 4 but with different structure coupling the motor shaft to the movable cutting member.
Figure 7:
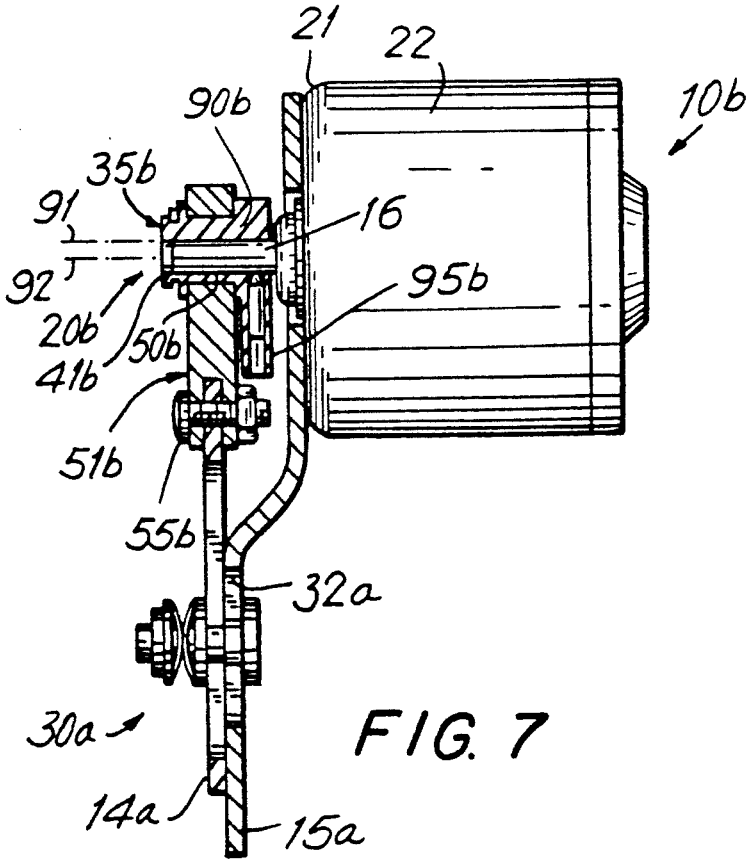
FIG. 7 is a side view of the cutting apparatus depicted in FIG. 6 with parts thereof shown in section.

The cutting apparatus 10*b* shown in FIGS. 6 and 7 is the same as apparatus 10*a* shown in FIGS. 4 and 5 except for coupling mechanism 20*b*. Sleeve 35*b* is similar to sleeve 35*a* in that the central axis 91 of sleeve 35*b* is eccentric with respect to the axis 92 of bore 41*b* and in that sleeve 35*b* includes a cylindrical portion 90*b* of reduced diameter and a counterweight mass 95*b* (of different shape than counterweight mass 95). Coupling mechanism 20*b* does not include bearing 37*a* which in cutting apparatus 10*a* is mounted in a hole in connecting member 51*a*. Instead, sleeve 35*b* of cutting apparatus 10*b* is received directly in a hole 50*b* of connecting member 51*b*, and at least one, and preferably both, of sleeve 35*b* and connecting member 51*b* are made of low friction material so that connecting member 51*b* is rotatably supported by sleeve 35*b*. This arrangement performs the same function as a bearing to rotatably mount connecting member 51*b* to sleeve 35*b*.

Figure 8:
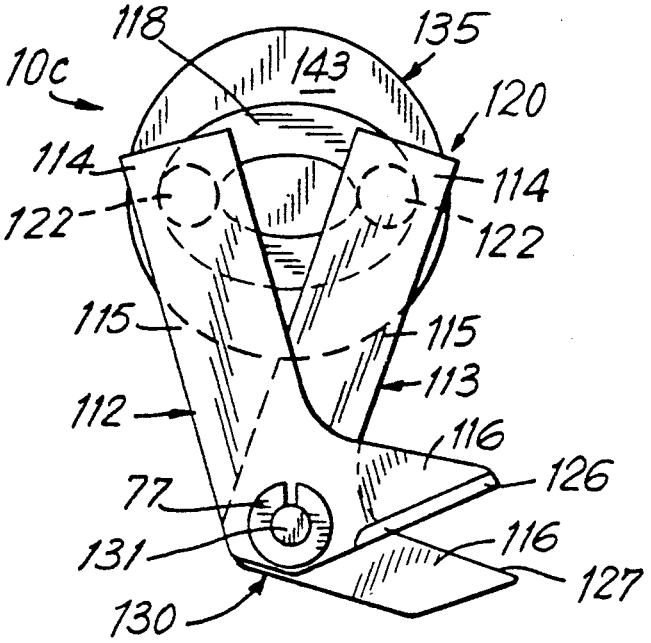
FIG. 8 is a front elevation view of apparatus for cutting sheet media according to another embodiment of the invention.
Figure 9:
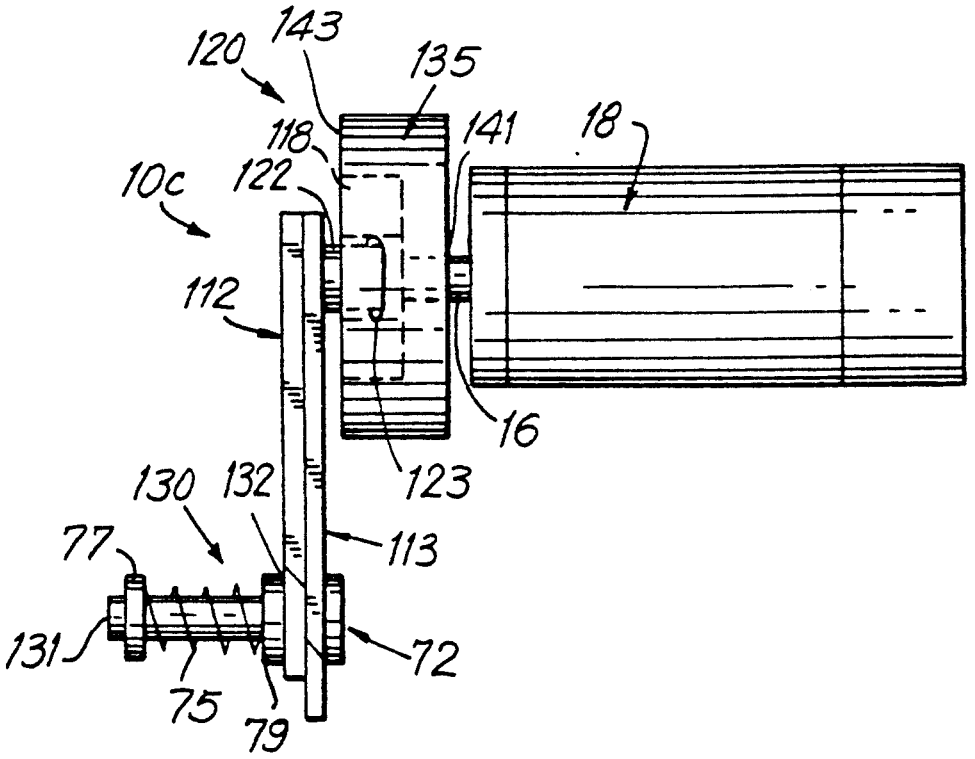
FIG. 9 is a side view of the cutting apparatus depicted in FIG. 8 with parts thereof shown in section.

FIGS. 8 and 9 depict cutting apparatus 10*c* which includes two movable cutting members 112 and 113 of generally L-shape. Each cutting member 112, 113 is coupled at the free end 114 of one leg 115 thereof to shaft 16 of motor 18 by coupling mechanism 120, and each cutting member has extending along the edge of the other leg 116 a cutting edge 126, 127. The cutting edges 126, 127 are (in cross section) each angled away from the other, i.e., converging towards the respective knife edge portions of the cutting edges. The movable first and second cutting members 112 and 113 are pivotally connected together by a pivot 130 in legs 116 near the cutting edges 126, 127 so that the movable first and second cutting members 112 and 113 pivot relative to each other. Pivot 130 comprises a pivot pin 131 and a hole 132 in which pivot pin 131 operates. Coupling mechanism 120 and pivot 130 cooperate to hold the first and second cutting members 112, 113 in an adjacent relationship with respective edge portions of cutting edges 126, 127 thereof spaced apart and facing each other such that cutting edges 126, 127 intersect to cut sheet media placed between the facing portions of thereof upon pivoting of the cutting members 112, 113.

Coupling mechanism 120 comprises cylindrical sleeve 135 (FIG. 9) fixed to motor shaft 16 to rotate therewith. Sleeve 135 has an axial bore 141 which receives motor shaft 16 therein, and an elliptical groove or recess 118 (FIG. 8) in an end face 143 thereof facing away from motor 18. Movable cutting members 112, 113 each have connected thereto at end 114 a pin 122 extending therefrom into elliptical groove 118 at diametrically opposite locations therein. Each pin 122 has an enlarged portion 123 (FIG. 9) at the free end thereof which is larger than the width of groove 118 so that pins 122 are captivated within groove 118 but may ride within the groove upon rotation of sleeve 135.

Elliptical groove 118 functions as a cam to move pins 122 along a substantially radial path as sleeve 135 rotates. The radial motion of pins 122 in cooperation with pivot 130 causes movable cutting members 112, 113 to both simultaneously pivot relative to each other. Cutting edges 126, 127 intersect at a point as described above in connection with cutting apparatus 10 of FIGS. 1 and 2, and the angle "b" (not designated in FIGS. 8 and 9) formed by cutting edges 126, 127 is as described above. Cutting action is as described above in connection with cutting apparatus 10.

In specific lightweight and compact embodiments of cutting apparatus 10, 10*a*, 10*b* and 10*c*, the electric motor is of the miniature low voltage DC type having a diameter in the order of one to two inches, and the cutting members are in the order of two to three inches long. Movement of the cutting edge or edges is less than about 0.10 inch, motor speed is in the order of 3000 to 5000 RPM and linear cutting speed is in the order 10 inches per second. Such cutting apparatus are especially suited for carriage mounting for use in plotters and printers due to their small size, light weight and high speed cutting, and also because they are simple and inexpensive to manufacture and maintain.

Sheet media which may be cut by cutting apparatus of the invention includes, among other materials, various types and grades of plotting and other media including paper, vellum, mylar, plastic and cardboard.

As pointed out above, cutting apparatus 10 has been found to be especially suited for cutting media parallel to the X-axis while the media is being moved parallel to the X-axis, and a circular-type cutting apparatus has been found to be especially suited for cutting media parallel to the Y-axis while the media is stationary. Referring to FIG. 10, a Y-axis cutting apparatus 150 is applied to a digital plotter 152 mounted to a carriage or transport device 154 that is moved by a Y-axis drive 156 across the media 158 (parallel to the Y-axis). Y-axis cutting apparatus 150 is a circular cutter of the type mentioned earlier, and preferably is a circular cutter as currently used in Houston Instruments DMP 162 R plotter available from Summagraphics Corporation. The media 158 is withdrawn from a supply roll 160 and moved parallel to the X-axis past a plotting head 162 by rollers 164, 165 at least one of which is rotated by X-axis drive 168. Carriage 154 and Y-axis cutting apparatus 150 are moved parallel to the Y-axis, and media 158 is held stationary while cutting apparatus 150 cuts media 158 from roll 160 along line 170 into a separate sheet 172. An X-axis cutting apparatus 10 (or 10*a*, 10*b* or 10*c*) according to the invention is applied to digital plotter 152 mounted to carriage 154 to slit media 158 parallel to the X-axis for the purpose of producing smaller width sheets 174, 175 and 176 from the larger width feed roll 160. Carriage 154 is moved to position cutter 10 at the desired location relative to media 158, and then the media is moved parallel to the X-axis while the cutting members of cutting apparatus 10 are reciprocated and/or pivoted.

Figure 11:
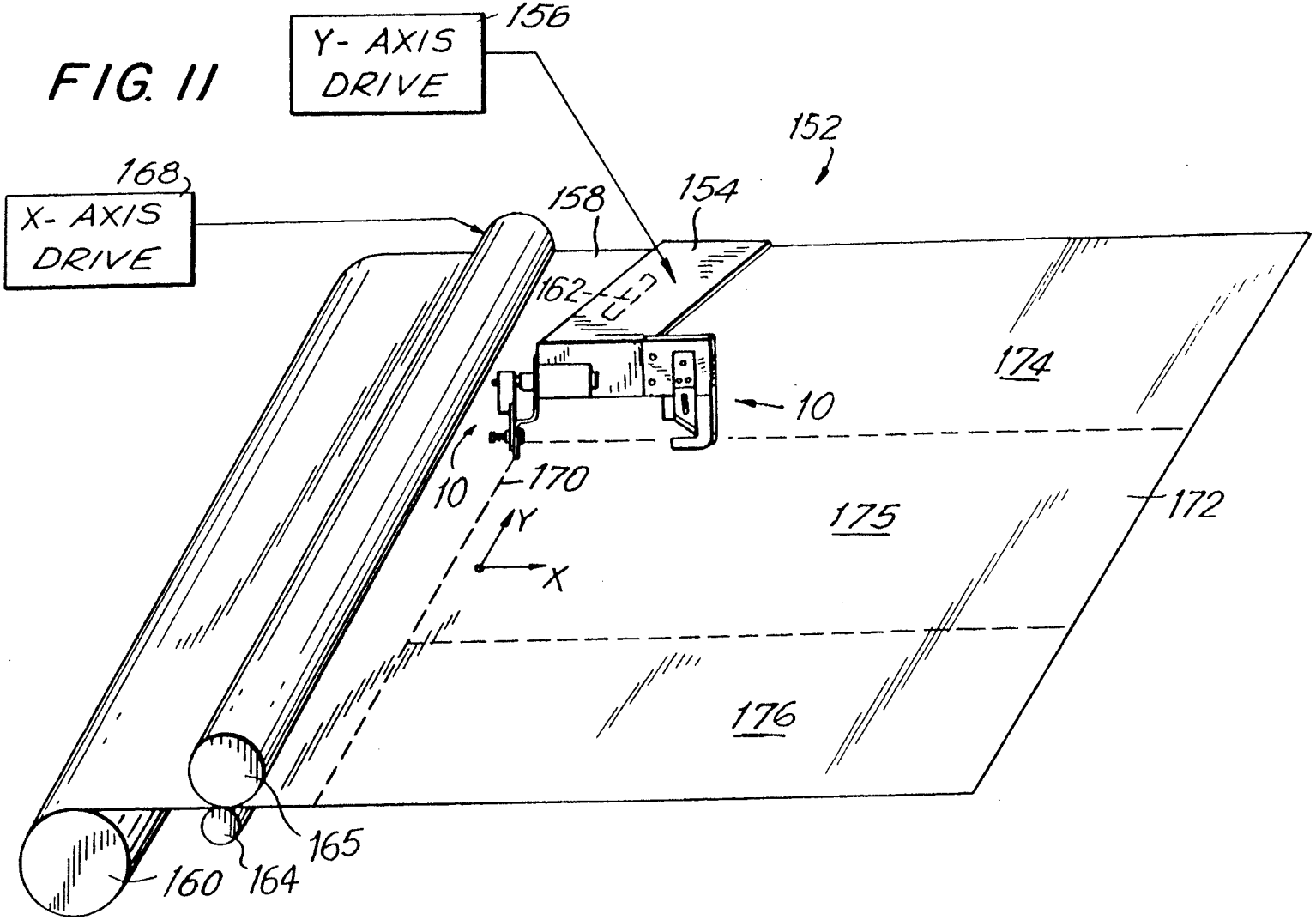
FIG. 11 is a schematic and block diagram of a plotter apparatus similar to that of FIG. 10, but with a different cutting apparatus for cutting the sheet media parallel to the Y-axis.

Referring to FIG. 11, a Y-axis cutter 10 (or 10*a*, 10*b* or 10*c*) may be applied to digital plotter 152 in place of Y-axis circular cutter 150. Thus, cutters 10 may be applied to digital plotter 152 for cutting parallel to both the X- and Y-axes.

Application of the inventive cutting apparatus in either or both X or Y-axis modes may be made in roll-fed plotters and business machines such as copiers, printers, sign cutters, blueprint machines, etc. Thus, a relatively wide sheet may be fed from a roll thereof, and not only cut to the desired length by a Y-axis cutting apparatus 150 or 10, but also cut in to smaller widths by an X-axis cutting apparatus 10. Accordingly, a 36 inch wide roll-fed media may be cut into 8½ inch by 11 inch page media.

Cutting apparatus according to the invention may also be applied to industrial sheet paper and plastic manufacturing machinery, in the X-or Y-axis mode or combination X-and Y-axis modes. Cutting apparatus according to the invention may be attached to the head of an X-Y positioning system such as an X-Y flatbed plotter (in which the media is stationary and the head is moved in the X-and Y-axes), and by providing suitable rotational guidance means to control the blade direction rotationally about the Z-axis, to produce multidirectional vector cutting of the media both in continuous angular directions and curves. Alternatively, cutting apparatus according to the invention may be attached to the movable plotter carriage 154 (FIG. 10), and a suitable rotational guidance means provided to control the blade direction rotationally about the Z-axis as carriage 154 is moved in the Y-axis simultaneously with movement of the media in the X-axis, to produce multi-directional vector cutting.

Although illustrative embodiments of the invention have been described and illustrated, it will be understood that the invention is not limited to the precise embodiments described and shown, and that various changes and modifications may be effected by one skilled in the art without departing from the scope or spirit of the invention.

We claim:

1. Apparatus for cutting sheet media comprising:

a carriage mounted to move in a first (Y) direction relative to a sheet media, first means for moving the carriage in the first direction, and sheet media cutting apparatus mounted to said carriage, said cutting apparatus comprising:

a first sheet media cutting device mounted to said carriage in a fixed orientation relative to the first direction for cutting the media in the first direction when said carriage is moved in the first direction, said first cutting device comprising a circular rotatable cutting member adapted to contact and cut the media during rotation thereof;

a second sheet media cutting device mounted to said carriage in a fixed orientation relative to a second (X) direction orthogonal to said first direction for cutting, while said carriage is stationary, the media along any of a plurality of lines extending in the second direction dependent upon the position of said carriage along the first direction, said second cutting device comprising first and second cutting members at least one of which is moved at least angularly relative to the other, said cutting members cooperating to cut sheet media placed therebetween, and means for moving said at least one cutting member angularly;

said first moving means moving said carriage in the first direction to desired positions in said first direction to position the second cutting device into desired positions at different first direction locations of the media; and second means for moving the media in the second direction while said carriage is stationary and said second cutting devices cuts the media in the second direction.

* * * * *